US008566969B2

(12) United States Patent
Glogowski et al.

(10) Patent No.: US 8,566,969 B2
(45) Date of Patent: Oct. 29, 2013

(54) ADJUSTABLE FITTING HELMET

(75) Inventors: Brian Glogowski, Williston, VT (US); John D. Fiegener, Marblehead, MA (US); Daniel Richard Armstrong, Fort Thomas, KY (US); Michael Tinstman, Malden, MA (US); Hans Dyhrman, Burlington, VT (US); John Fowler, Essex Junction, VT (US)

(73) Assignee: The Burton Corporation, Burlington, VT (US)

( * ) Notice: Subject to any disclaimer, the term of this patent is extended or adjusted under 35 U.S.C. 154(b) by 458 days.

(21) Appl. No.: 12/359,279

(22) Filed: Jan. 23, 2009

(65) Prior Publication Data

US 2010/0180363 A1 Jul. 22, 2010

Related U.S. Application Data

(63) Continuation-in-part of application No. 12/355,620, filed on Jan. 16, 2009, now abandoned.

(51) Int. Cl.
*A42B 3/00* (2006.01)

(52) U.S. Cl.
USPC ..... 2/414

(58) Field of Classification Search
None
See application file for complete search history.

(56) References Cited

U.S. PATENT DOCUMENTS

| | | | | |
|---|---|---|---|---|
| 3,609,764 | A * | 10/1971 | Morgan | 2/414 |
| 4,006,496 | A * | 2/1977 | Marker | 2/414 |
| 4,133,055 | A * | 1/1979 | Zebuhr | 2/411 |
| 4,134,156 | A * | 1/1979 | Gyory | 2/413 |
| 4,710,984 | A * | 12/1987 | Asper et al. | 2/412 |
| 5,014,365 | A * | 5/1991 | Schulz | 2/412 |
| 5,083,320 | A | 1/1992 | Halstead | |
| 5,175,889 | A * | 1/1993 | Infusino | 2/413 |
| 5,263,203 | A * | 11/1993 | Kraemer et al. | 2/413 |
| 5,351,710 | A | 10/1994 | Phillips | |
| 5,435,230 | A | 7/1995 | Phillips | |
| 5,539,934 | A * | 7/1996 | Ponder | 2/413 |
| 5,720,051 | A | 2/1998 | Johnson | |
| 5,826,281 | A | 10/1998 | Rush, III | |
| 5,890,232 | A | 4/1999 | Park | |
| 6,073,271 | A | 6/2000 | Alexander et al. | |
| 6,161,240 | A | 12/2000 | Huang | |
| 6,178,560 | B1 | 1/2001 | Halstead et al. | |

(Continued)

FOREIGN PATENT DOCUMENTS

| | | |
|---|---|---|
| EP | 0 423 711 A1 | 4/1991 |
| FR | 2 888 729 | 1/2007 |

(Continued)

OTHER PUBLICATIONS

International Search Report and Written Opinion, PCT/US09/006702, mailed Sep. 6, 2010.

*Primary Examiner* — Khoa Huynh
*Assistant Examiner* — Anna Kinsaul
(74) *Attorney, Agent, or Firm* — Wolf, Greenfield & Sacks, P.C.

(57) ABSTRACT

A helmet includes a helmet body defining a helmet interior. A fit system is provided to engage the helmet to the head of a wearer, at least a first and second portion of the fit system are moveable independent of the other. A fit adjuster varies a characteristic of the fit system, such as size, shape, orientation or pressure, allowing a wearer to customize fit of the helmet.

9 Claims, 5 Drawing Sheets

(56) References Cited

U.S. PATENT DOCUMENTS

| | | | | |
|---|---|---|---|---|
| 6,226,801 | B1 | 5/2001 | Alexander et al. | |
| 6,351,853 | B1 | 3/2002 | Halstead et al. | |
| 6,381,757 | B2 | 5/2002 | Rush, III | |
| 6,426,865 | B2 | 7/2002 | Kasahara et al. | |
| 6,490,730 | B1 | 12/2002 | Lyden | |
| 6,530,092 | B2 | 3/2003 | Pope | |
| 6,591,428 | B2 | 7/2003 | Halstead et al. | |
| 6,637,037 | B1 | 10/2003 | Hung | |
| 6,671,889 | B2 * | 1/2004 | Dennis et al. | 2/411 |
| 6,925,657 | B2 * | 8/2005 | Takahashi et al. | 2/412 |
| 7,003,803 | B1 | 2/2006 | Lyden | |
| 2004/0117897 | A1 | 6/2004 | Udelhofen et al. | |
| 2006/0031978 | A1 | 2/2006 | Pierce | |

FOREIGN PATENT DOCUMENTS

| | | | |
|---|---|---|---|
| FR | 2 918 849 | A1 | 1/2009 |
| IT | 1240251 | | 11/1993 |
| JP | 4194005 | | 7/1992 |
| JP | 7166406 | A | 6/1995 |
| JP | 11222709 | | 8/1999 |
| WO | WO 2007/114720 | A1 | 10/2007 |

* cited by examiner

ADJUSTABLE FITTING HELMET

RELATED APPLICATIONS

This application claims the benefit under 35 U.S.C. §120 of U.S. application Ser. No. 12/355,620, entitled "Adjustable Fitting Helmet," filed on Jan. 16, 2009, which is herein incorporated by reference in its entirety.

FIELD OF THE INVENTION

The invention relates to a helmet and to other head gear and, more particularly, to an adjustable fitting helmet.

BACKGROUND

Various systems have been proposed for fitting a helmet to a head of a wearer. Such head fitting systems may allow a wearer to customize the helmet to different head shapes and sizes, and may allow for altering the tightness of the helmet about the head of the wearer. Typically, a head fitting system includes a loop-shaped band of variable length. In certain arrangements, an inflatable bladder has been provided to vary the fit of a helmet. One or more pads may be provided on the variable length bands or the inflatable bladder.

SUMMARY

One aspect of the invention includes a helmet with a helmet body defining an interior portion. A head fitting system has a first portion and a second portion that are moveable independent of each other. A fit system adjuster is located between the body and the fitting system, and is selectively actuable to move the first portion and the second portion, customizing a fit of the helmet to a head of a wearer.

In another aspect of the invention, a helmet includes a helmet body having an interior portion. The helmet body defines a relief and a shelf extending above, and inwardly of, the relief. A head fitting system extends downwardly from the shelf and a fit system adjuster is located in the relief.

In another aspect of the invention, a helmet includes an outer shell and an impact managing liner located within the outer shell. At least two pads are coupled to the liner and arranged to independently move with respect to each other and towards an interior of the helmet. An inflatable bladder is located between the liner and the at least two pads, the bladder being selectively inflatable to move the at least two pads towards the helmet interior, customizing a fit of the helmet to a head of a wearer.

In a still further aspect of the invention, a helmet includes a helmet body defining an interior portion. A head fitting system includes a plurality of connectors to attach the head fitting system to the helmet body. A fit system adjuster to adjust a characteristic of the head fitting system includes a plurality of position locating tabs. The helmet body is adapted to receive the plurality of position locating tabs and is adapted to receive the plurality of connectors.

These and other aspects of the invention will be appreciated from the following description and drawings.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1A:
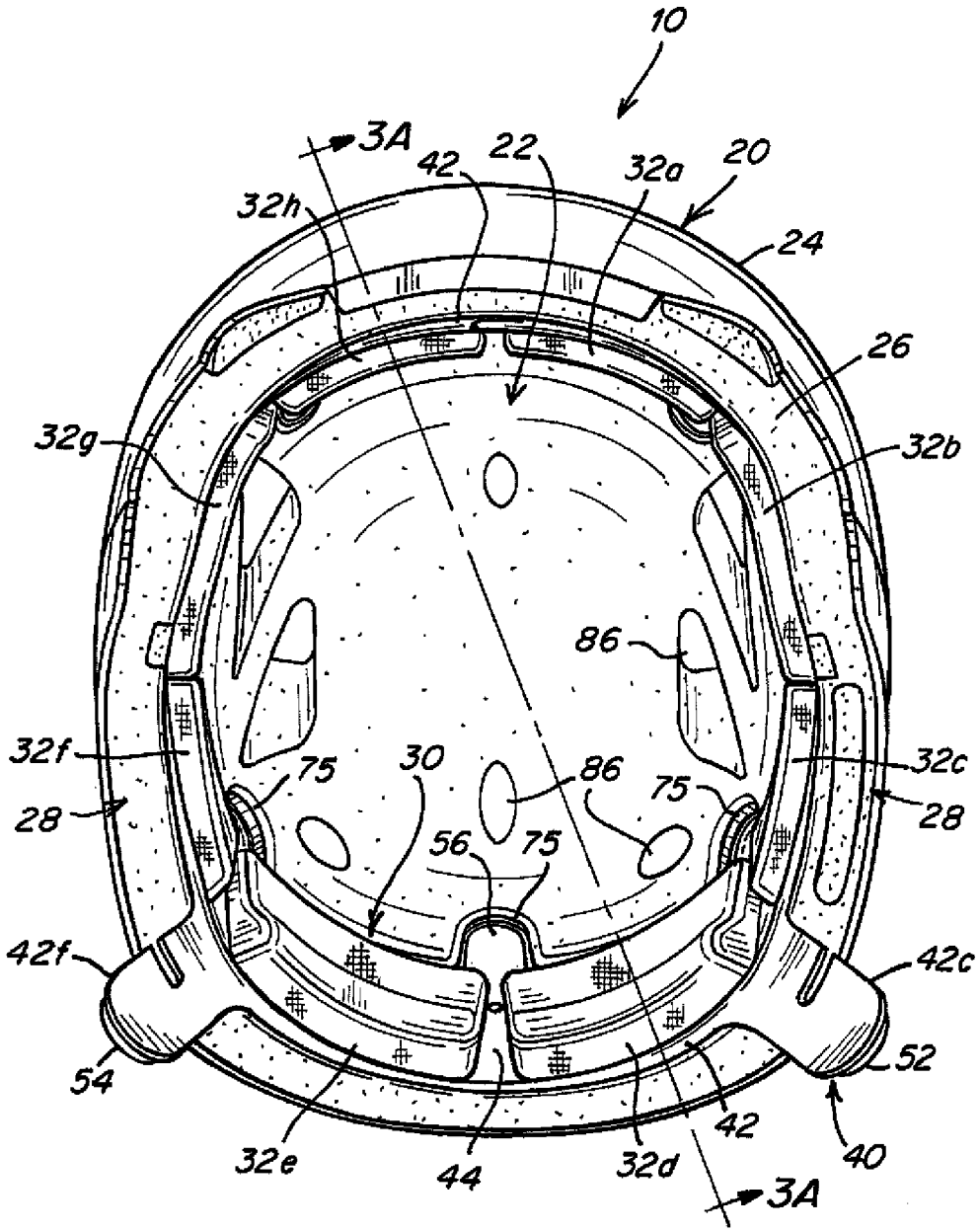
FIG. 1A is bottom view of a helmet according to certain embodiments, showing an internal space of the helmet.

For case of understanding and without limiting the scope of the invention, aspects of the invention are discussed herein in connection with a snowboard helmet. However, the invention is not so limited, and includes helmets configured for other applications including, but not limited to, skiing, waterskiing, wakeboarding, roller blading, biking, football, snowmobiling, jet skiing, all terrain driving, and motorcycling. Further, the helmet may be configured to protect the head of the wearer or may be arranged in a non-protective form. The invention encompasses other types of head gear in addition to helmets.

Head shape and size vary amongst different people and a particular individual's head geometry may not be symmetrical. A person may wear a cap or other head covering under a helmet, may change hair style or hair length, or otherwise alter the head profile upon which a helmet should securely and safely fit. Depending upon the activity involved, and the environment of use, a wearer may desire a tighter or looser fit of her helmet. For any one of the foregoing, or for other reasons, a helmet is provided that allows the wearer selectively to customize a fit characteristic (e.g., shape, size, to orientation or pressure), either prior to placing the helmet on her head, or while already wearing the helmet and without having to loosen straps or other features that secure the helmet to the head of the wearer.

A head fitting system may be provided along some, or all, points of contact between the helmet and the head of the wearer. For example, and without limitation, a head fitting system may encircle the head of the wearer, extending along the left and right temple portions, the forehead and the back of the head, but not covering the crown. The fit system may be arranged to promote a particular orientation of the helmet relative to the head of the wearer; for example, and without limitation, the helmet may be configured to provide a tighter fit to specific portions of the head, and/or to tilt the helmet in a particular direction. The fit system may include various segments with the same or different fit characteristics. For example, and without restriction, the fit system may include different segments, such as pads, that may be arranged to move independently of each other, whether towards or away from the interior of the helmet body, changing the size and shape of the fit system. The fit system may include separate components that cooperate together or may be an integral structure.

A fit system adjuster, that may be integral with the fit system or provided as a separate component that acts on the fit system, allows the wearer to vary fit characteristics of all, or only specific, segments of the fitting system. For example, and without restricting the scope of the invention, greater adjustment of the fit system may occur at the rear of the helmet as compared to the front of the helmet. Adjustment of characteristics of the fit system may include, without limitation, expanding and/or contracting the dimension of the fit system at one or more locations about the fit system, changing the angle of a point of contact of the fit system with the head of the wearer at one or more locations about the fit system, adjusting the positioning of the fit system (e.g., raising, lowering, shifting sideways), and adjusting the pressure of the fit system (i.e., tightness). The helmet may be configured so that different levels of adjustment are applied, of the same or different characteristics, along different segments of the fit system. Further, portions of the fit system may be non-adjustable while others may be varied to customize the overall fit.

Figure 1B:
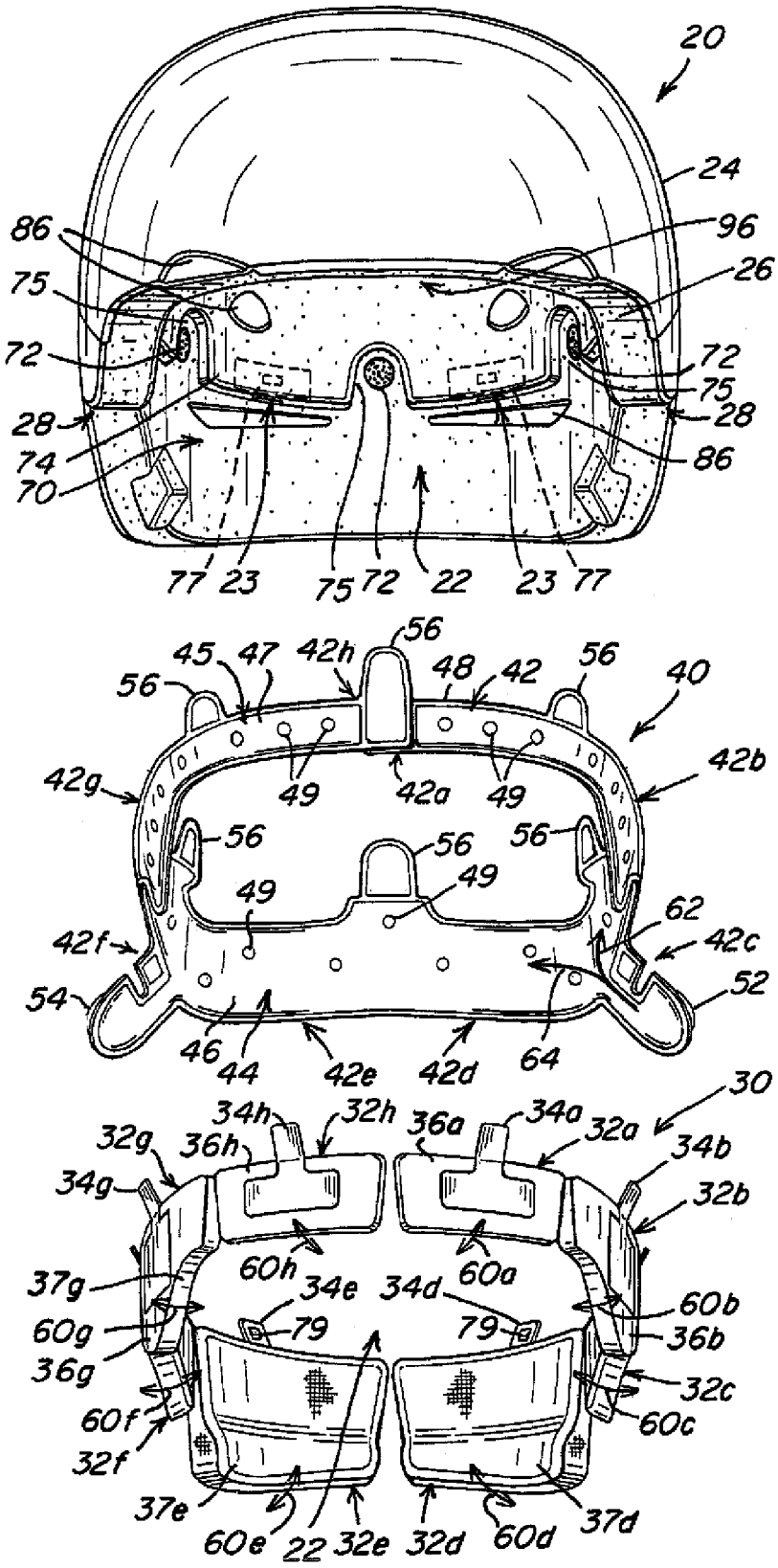
FIG. 1B is an exploded perspective view of the helmet of FIG. 1.

A helmet 10, shown in FIGS. 1A-1B, includes a helmet body 20, a helmet fitting system 30 and a selectively activated fit system adjuster 40 for varying the shape, size, orientation, pressure, and/or other aspect of at least some portion of the fitting system that will come in contact with the head of the wearer (i.e., fitting system is adjusted relative to the helmet interior 22). As illustrated, the helmet body 20 includes an outer shell 24 and an impact energy managing liner 26, the fitting system 30 includes a series of pads 32*a*-32*h* that extend around the helmet interior 22, and the fit system adjuster 40 is an inflatable bladder 42 located between the helmet body 20 and the fit system 30 that may be selectively actuated to apply force to, or relieve previously applied force from, portions of the fit system 30, to adjust one or more fit characteristics (e.g., shape, size, tightness/pressure, orientation) of the helmet 10.

As shown, the fit system 30 may include one or more pads 32*a*-32*h* that encircle the helmet interior. The pads 32*a*-32*h* may be shaped to conform substantially to the portion of the head that they will contact. Accordingly, certain of the pads may have more of a rounded, concave surface while other pads may be flatter. Each pad 32*a*-32*h* may pivot relative to the helmet body 20 and be arranged to move independently with respect to each other 32*a*-32*h*, and to the helmet body 20, in response to inflation or deflation of the bladder 42. As the shape, size and orientation may vary amongst the pads 32*a*-32*h*, and the force applied by the bladder 42 may be differentiated along predetermined segments of the adjuster, various fit characteristics may be provided at each pad 32*a*-32*h*. For example, and without limitation, the expandable volume of the bladder 42 at the front of the helmet 10 may be considerably smaller than the expandable volume of the bladder 42 at the rear of the helmet 10, so that the rear pads 32*d*, 32*e* may be displaced a greater amount or greater pressure may be applied to the rear pads 32*d*, 32*e* as compared to the pads 32*a*, 32*h* at the front of the helmet. Although shown as individual, spaced pads, the fit system 30 is not so limited and may include an integrated, single structure with the fit characteristics of various segments being adjustable.

The fit system 30 need not be in the form of pads and embraces other structure and arrangements configured to contact the head of the wearer (e.g. a band or a comfort liner). Further, not all aspects of the fit system that come in contact with the head of the wearer need to be adjustable, so long as at least some portions of the fit system are variable in response to actuation of the fit adjuster. For example, and without limitation, a fit system employing pads 32*a*-32*h* such as shown in FIGS. 1A-1B, might have temple pads that are not adjustable while the front and rear pads are adjustable. Portions of the fitting system 30 that contact the wearer's head may include a soft or compliant material, or otherwise be arranged for comfort (e.g. foam, compliant plastic or rubber layers or other cushioning materials). The head fitting system may be arranged to provide improved performance such as insulation or wicking. In a representative embodiment, the pads are formed of fabric wrapped Ethylene Vinyl Acetate (EVA).

Figure 3A:
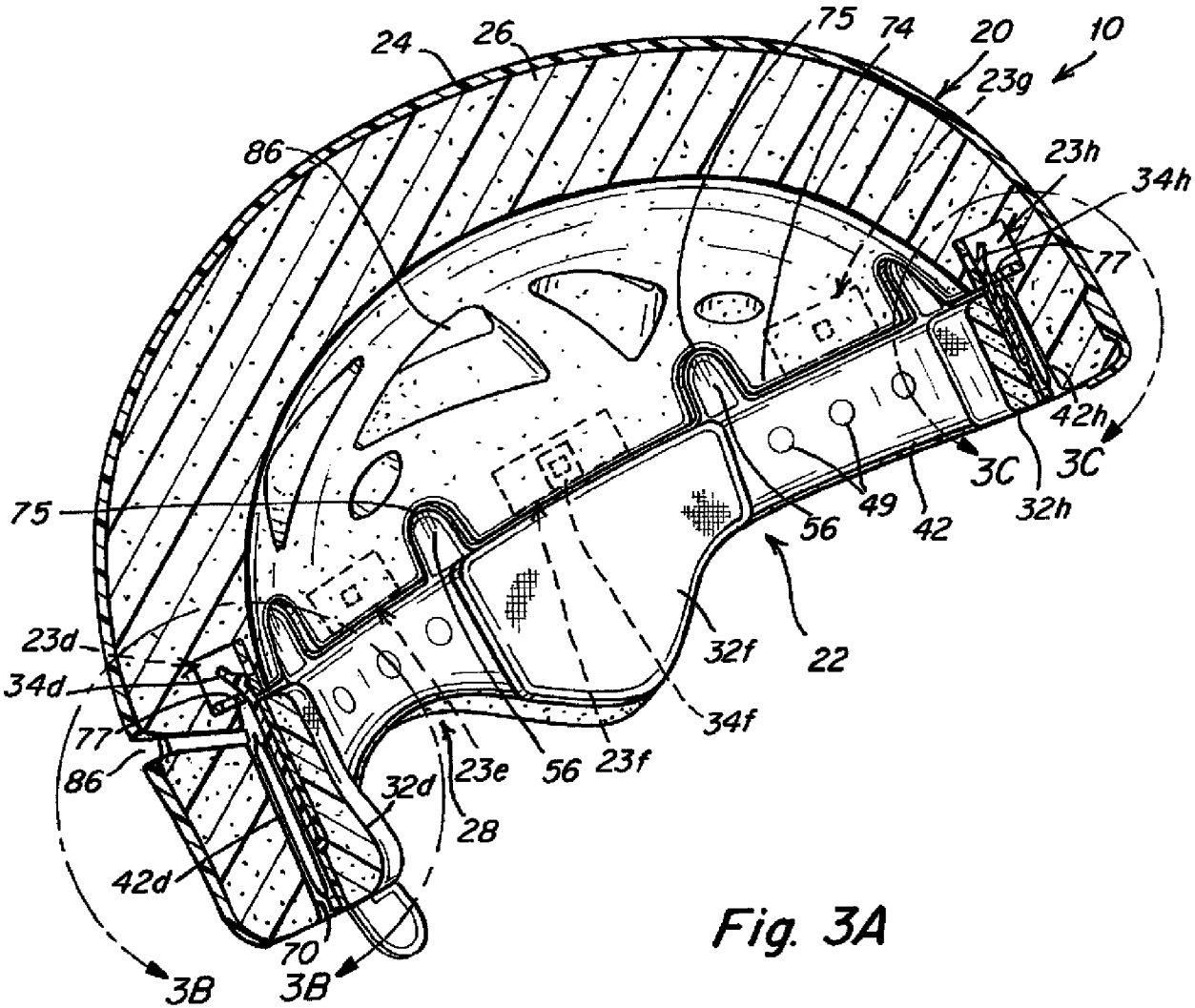
FIG. 3A is a cross-sectional view of the helmet of FIG. 1A taken along line 3A-3A.
Figure 3C:
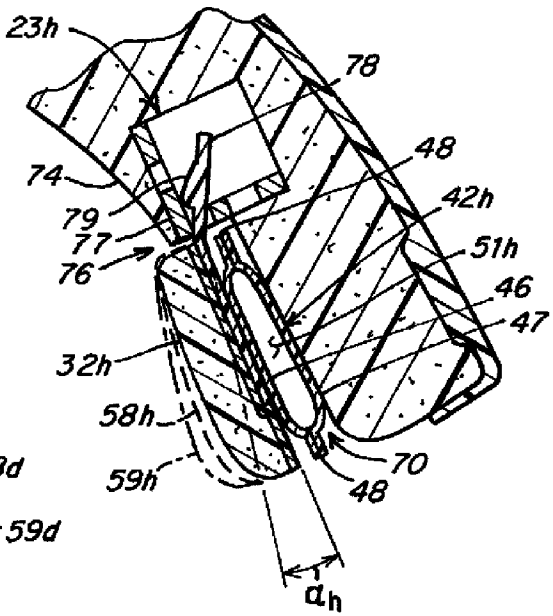
FIG. 3C is an enlarged detail view of the area encircled by arrows 3C-3C of FIG. 3B illustrating movement of a front pad.
Figure 3B:
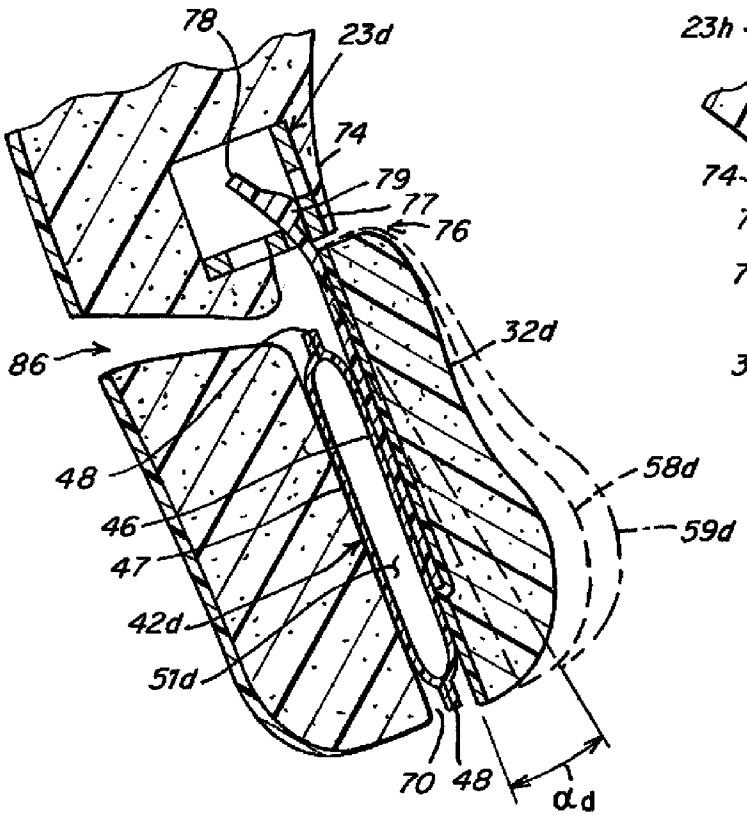
FIG. 3B is an enlarged detail view of the area encircled by arrows 3B-3B of FIG. 3A illustrating movement of a rear pad.

One or more pads 32*a*-32*h* may include a connector 34*a*-34*h*, as shown, which engages with a complementary connector 23*a*-23*h* (e.g. an anchor) in the helmet body (see also FIGS. 3A-3C). The connector 34*a*-34*h* and/or its associated pad 32*a*-32*h* may be configured to provide movement of the pad in response to the fit adjuster 40. As illustrated, each of the pads includes a thin, tab-like connector 34*a*-34*h* that extends from a backing sheet 36*a*-36*h* united with the pad body 37*a*-37*h*, so that each pad is pivotable towards and away from the helmet interior. For simplicity, some reference numbers have been omitted on some of the pads 32*a*-32*h*. Other arrangements for pivoting of the pad, such as a living hinge or other designs, also are contemplated. In other embodiments, one or more pads may be pivotable in a single direction, and/or may be arranged to rotate and/or translate with respect to the helmet body 20. The tab 34*a*-34*h* and backing sheet 36*a*-36*h* may be slightly angled, as shown, to facilitate pivoting of the pad 32*a*-32*h* in response to the fit adjuster 40.

To adjust a characteristic of the fitting system 30, a fit adjuster 40, such as an inflatable bladder 42, is located between the helmet body 20 and the fitting system 30, such as the series of pads 32*a*-32*h* shown in FIGS. 1A-1B. Selective inflation or deflation of the bladder 42 will cause the pads 32*a*-32*h* to move inwardly or outwardly, allowing the wearer to customize the fit of the helmet 10. Arrows 60*a*-60*f* in FIG. 1B illustrate a representative movement of each pad 32*a*-32*h*, in response to inflation of the bladder. As shown, the expanded bladder 42 forces the pads 32*a*-32*h* to pivot towards the helmet interior 22, reducing the size of the fit system 30 and/or increasing the pressure of the fit system 30 about the head of the wearer (see also FIGS. 3A-3C). Depending upon the size and shape of the various pads or other configuration of the fit system, greater size reduction or expansion, or pressure, may be applied to a particular portion of the fit system. As shown, the rear pads 32*d*, 32*e* may be larger than the front pads 32*a*, 32*h*, and associated rear portions of the inflatable bladder 42*d*, 42*e* may have a larger volume that associated front portions 42*a*, 42*h* of the inflatable bladder. The independent pivotable arrangement of the pads, or other fit system, allows variable response to the fit adjuster.

As shown, the bladder may include a pump 52 for inflating the bladder 42 and a separate release valve 54 for deflating the bladder 42. The pump 52 and the release valve 54 are located at a left extension portion 42*c* and at a right extension portion 42*f* of the bladder, respectively, and each projects from an car cutout portion 28 of the helmet body, allowing the wearer to easily access them for fit adjustment. Air introduced by the pump 52 flows into and through the bladder 42 along dual paths: along a first flow path to left end portion 42*a* (indicated by arrow 62) and along a second flow path to right end portion 42*h* (indicated by arrow 64). In other embodiments, the pump may be located at one end portion of the bladder and a release valve at the other end portion, so that flow is along a single path. The number and direction of flow paths may vary as should be apparent to one of skill in the art. In one embodiment, the pump and release valve may be a pump and a valve described in any of U.S. Pat. No. 5,435,230, U.S. Pat. No. 5,351,710, and U.S. Pat. No. 5,074,765, each of which is herein incorporated by reference in its entirety, or the pump and/or the valve may have a different arrangement. The pump 52 may be manually-activated, however, other embodiments may employ a different type or design of pump, such as an electrical pump, as the invention is not limited in this respect. Further, although in the described embodiment air is the inflation medium, other gases or liquids may be used to expand the bladder. Other arrangements for inflating and deflating an inflatable bladder are contemplated. For example, and without limitation, the bladder 42 may include a single port for receiving a separate pump to inflate the bladder and have a release pin or other valve arrangement for deflating the bladder. Extension portions 42*c*, 42*f* and other exposed portions of the bladder 42 may be covered with a protective padding 94 or otherwise shielded or reinforced to protect them from damage.

The bladder 42 may include a first end portion 42*a* and a second end portion 42*h* that are joined together, forming a loop about the inside of the helmet body so that the bladder encircles the head of the wearer as shown in FIG. 1B. Various portions of the bladder are now identified based on the portions of the head against which they will be opposed. The first end portion 42*a* and second end portion 42*h* correspond to the forehead of the wearer. Left side portion 42*b* and right side portion 42*g* are positioned overlying the left and right sides of the wearer's head, respectively. A left extension portion 42*c* of the bladder extends behind the wearer's left ear and a right extension portion 42*f* of the bladder extends behind the wearer's right ear. Left rear portion 42*d* and right rear portion 42*e* overlie the wearer's rear occipital lobe. Although the inflatable bladder 42 depicted in FIGS. 2A and 2B encircles a wearer's head with end portions 42*a* and 42*h* overlying a wearer's forehead, in other embodiments the inflatable bladder need not fully encircle the wearer's head. Although not shown, the bladder 42 may extend partially or completely over the crown of the wearer's head.

Figure 2:
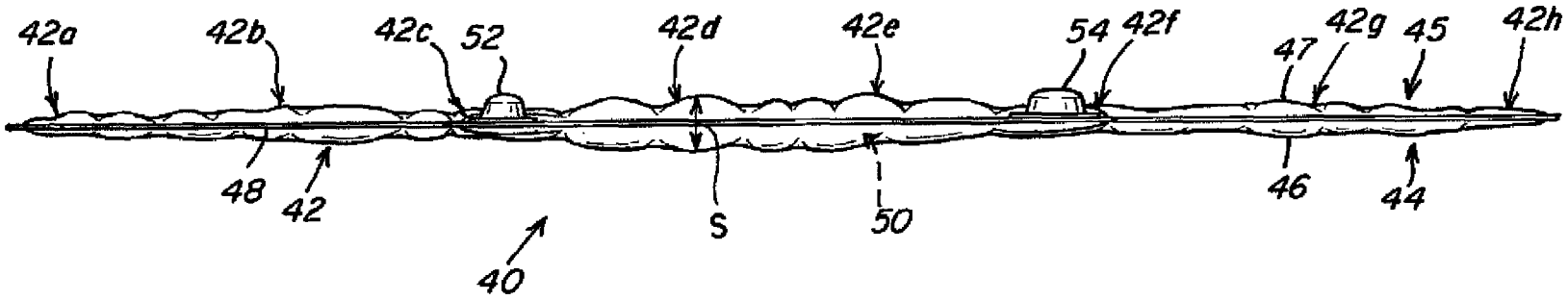
FIG. 2 is a side view of an inflatable liner.

In FIG. 2 which shows a side view of the bladder 42 when partially inflated, the thickness of the bladder 42 is exaggerated for illustrative purposes. The bladder 42 has a side that faces the fitting system 30 and the wearer's head during use, which will be referred to as the "head side" 44, and a side that faces the helmet body 20, which will be referred to as the "helmet side" 45. In some embodiments, the bladder 42 has a first sheet of material 46 forming the head side 44 and a second sheet of material 47 forming the helmet side 45, that are joined to each other around a peripheral edge 48 enclosing an inflatable space 50. The first sheet 46 and the second sheet 47 may additionally be joined at one or more locations away from the peripheral edge 48 of the bladder to control a size and a shape of the inflatable space 50. For example, the first sheet 46 may be joined to the second sheet at multiple weld areas 49 as shown in FIG. 3A. The first sheet 46 and the second sheet 47, may be welded, adhered or sealably joined in any other suitable manner. The material 46 of the first sheet 46 and/or the second sheet 47 may be any suitable pliable and fluid impermeable material including, but not limited to, a polymer such a urethane. Although the inflatable bladder 42 depicted in FIGS. 1B and 2 includes a first sheet of material 46 joined to a second sheet of material 47 at the periphery 48 of the bladder 42, an inflatable bladder 42 may be seamless or may be, formed of multiple different sheets of material that are joined at areas other than the periphery 48 to form an inflatable space, as the invention is not limited in this respect.

To adjust a fit of the helmet, a wearer may introduce air into the bladder 44 using the pump 52, which inflates the bladder thereby increasing a separation S between the head side 44 and the helmet side 45 of the bladder 42. Further inflation of the bladder 42 increases the fluid pressure in the inflation space 50. The head side 44 of the bladder exerts a force on the corresponding portion of the fitting system 30 (e.g. pad 32*a*-32*h*. A to wearer may decrease the force by deflating the bladder 42 using the release valve 52.

Interactions between the fit system adjuster 40, the fitting system 30, and the helmet body 20 are further illustrated in FIGS. 3A-3C. (In FIG. 3A several pads are omitted for illustrative purposes.) The fit system adjuster 40, such as the inflatable bladder 42 shown, may follow the contour of a lower portion of the helmet body. As described above, each pad 32*e*-32*h* contacts at least a portion of the bladder 42. Initially, the bladder 42 may be slightly inflated. In this state the bladder 42 exerts relatively little force on the pads 32*e*-32*h*, which may be characterized as being in a neutral position. The wearer may then inflate the bladder 42, exerting a force on each pad 32*e*-32*h*. Because each pad 32*e*-32*h* is moveable relative to the other pads, the position and/or orientation of each pad 32*e*-32*h* independently adjusts in response to the pressure. A representative changed position of pads 32*d* and 32*h* is indicated by dashed outlines 58*d* and 58*h*. Increased pressure in the bladder 42 also increases the pressure exerted by each pad 32*e*-32*h* on the head of the wearer.

The wearer may continue to inflate the bladder 42 until achieving a desired fit. The increased pressure may further change the position and/or orientation of each pad as indicated by dotted and dashed outlines 59*d* and 59*h*. One or more pads may already be in contact with the head of the wearer so that further inflation will not move these pads, although the increased pressure in the bladder will exert greater force on the head of the wearer, providing a tighter or more secure fit.

As can be seen in FIGS. 3B and 3C, the left rear pad 32*d* pivots through an angle $\alpha_d$ that is greater than an angle $\alpha_h$ through which the right front pad 32*h* pivots. The difference in angular adjustability is due to the relative size and shape of the left rear pad 32*d* and the right front pad 32*h* and due to the relative size and shape of the corresponding portions 42*d*, 42*h* of the inflatable bladder. The interior space 50 in the left rear portion 42*d* of bladder has a greater maximum cross-sectional area 51*d* than the maximum cross-sectional area 51*h* of the interior space in the right end portion 42*h* of the bladder at the front of the helmet. This allows the left rear portion 42*d* to cause greater rotation of its corresponding pad 32*d* and to exert a greater force on its corresponding pad 32*d*. The greater rotation may enable the rear pads 32*d* and 32*e* to better accommodate an occipital lobe at the rear of the wearer's head.

FIG. 3A also depicts the cross-sectional shape of the helmet body 20 and a location of the fit system adjuster 40 in the helmet body 20. As described above and shown in FIG. 1B, the helmet body 20 may include an outer shell 24 and an impact absorbing, or otherwise impact energy managing, liner 26 located within the outer shell. The outer shell 24 may include, but is not limited to: a hard material, a puncture resistant material, a soft material, a textile material and/or multiple layers of different materials. As an example, the outer shell 24 may be formed of a hard material such as acrylonitrile butadiene styrene (ABS), polycarbonate, fiber composite, or other suitable material as should be apparent to one of skill in the art. The impact-managing liner 26 may be formed of a crushable foam, such as an expanded polystyrene (EPS), expanded polypropylene or expanded polyurethane, or other suitable impact-absorbing and/or energy managing material. The liner may be in-molded to the shell, or the shell and liner may be separately formed and then joined together such as by adhesive or tape. Although aspects of the helmet body 20 are described with respect to an embodiment having an outer shell 24 and a liner 26, the helmet body may include only a liner 26, only an outer shell 24, or either or both helmet body components including further layers, as the invention is not limited in this respect.

The helmet may include features to position and maintain the fit adjuster in a desired location. As shown, a lower portion of the helmet body, such as a liner 26, may include a relief 70 which receives the fit adjuster 40. The relief may extend completely about the helmet body, for example where the fit adjuster encircles the helmet, or may have a truncated shape corresponding to the configuration of the fit adjuster. The fit system adjuster 40, such as the inflatable bladder 42 shown, may follow the contour of the relief 70. The fit adjuster 40 may include engagement features to secure the fit adjuster to the helmet body. For example, at least one and preferably multiple position locating tabs 56 may extend from the fit adjuster and engage with complementary anchoring portion (s) 72 on the helmet body 22. An adhesive, a mechanical coupling, hook and loop material (e.g. VELCRO), etc., may be employed to join the tabs, or other engagement feature to the helmet body. As such, the fitting system 30 may be detachably or permanently connected to the body interior 22. It may be desirable for portions or all of the head fitting system 30 to be detachable to permit use of fitting systems having different sizes and configurations with the helmet body 20, for cleaning or repair or otherwise.

Above and inwardly of the relief, the helmet body may define a shelf 74 from which the fit system 30 depends. The relief 70 extends upwardly creating spaced relief regions 75 that separate the shelf 74 into segments. Each of the spaced relief regions 75 is adapted to receive a positioning tab of the fit adjuster 40. The shelf 74 may also include the anchoring portions 72 for the fit adjuster tabs. The pads 32*a*-32*h* of the fitting system 30 may extend downwardly from the shelf 74 in the path of movement of the inflatable bladder. The shelf may include part of an engagement system 76 for mounting the pads. As shown, the engagement system 76 may be a snap fit receptacle 77 for receiving a tab 78 and boss 79 extending from a pad. Sufficient insertion pressure will cause the boss portion 78 of the tab 79 to penetrate into the receptacle 77, securing the pad 32 in position. Removal of the pad 32 is achieved by pulling the pad 32 until the locking force of the snap fit receptacle 77 is overcome. Other connectors, whether permanently fixing the pads to the helmet body or allowing detachment, are contemplated. Although the engagement system shown in FIGS. 3A-3C includes a tab end of a pad that is engageable to a locking chamber of a shelf, the features may be reversed with the male component on the shell and the female component on the pad. Without limitation, the connectors 34 and/or mating connectors 23 may include a detent, a ball and socket, a key and slot or any other suitable connecting feature or mechanism.

The snowboard helmet may further include other features such as chin straps for securing the helmet to the wearer, passive and/or active vents in the helmet body 86, a retention system for securing a goggle to the helmet, a contoured front opening 96 for receiving a goggle, additional layers on or in the helmet body for insulation, comfort, or other attribute, and padding covering at least a portion of the straps. Other known features may be incorporated into helmets falling within the scope of the claimed invention.

It should be understood that aspects of the invention are described herein with reference to the figures, which show illustrative embodiments in accordance with aspects of the invention. The illustrative embodiments described herein are not necessarily intended to show all aspects of the invention, but rather are used to describe a few illustrative embodiments. For example, although aspects of the invention are described above with reference to a snowboard helmet, aspects of the invention may be used with any suitable helmet. Further, the fit system adjuster is not limited to an inflatable bladder, and other arrangements for varying one or more characteristics of the fit system are contemplated. For example, and without limitation, the fit system adjuster may include an internal or external skeleton or frame, having a size, shape, and or angular orientation that may be selectively varied.

Thus, aspects of the invention are not intended to be construed narrowly in view of the illustrative embodiments. In addition, it should be understood that aspects of the invention may be used alone or in any suitable combination with other aspects of the invention.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A helmet, comprising:

a helmet body including a hard outer shell and an impact energy managing inner liner, wherein the liner includes a first surface extending at least partially around an interior portion of the liner, wherein the liner includes a second surface extending at least partially around the interior portion of the liner and spaced inward from the first surface, wherein the liner includes a shelf extending from above, and inward of, the first surface to the second surface, and wherein the first surface and the shelf define a relief in the liner;

a head fitting system; and a fit system adjuster locatable in the relief, the fit system adjuster operable on the head fitting system to vary a fit characteristic of the helmet, wherein the head fitting system includes at least two separate portions that are moveable independent of each other in response to actuation of the fit system adjuster.

2. The helmet of claim 1, wherein the relief encircles an interior space of the helmet.

3. The helmet of claim 1, wherein the relief extends upwardly creating spaced relief regions that separate the shelf into segments, each of the spaced relief regions adapted to receive a positioning tab of the fit adjuster.

4. The helmet of claim 1, wherein the shelf includes a surface that faces towards a bottom of the helmet body, and said surface is adapted to engage with the head fitting system.

5. The helmet of claim 1, wherein the fit system adjuster is an inflatable bladder and the head fitting system is a plurality of pads.

6. The helmet of claim 1, wherein the at least two independently moveable portions are pivotable towards the helmet interior.

7. The helmet of claim 1, wherein the fit system is attachable to the helmet body independent of the fit adjuster.

8. The helmet of claim 1, wherein the fit system adjuster follows the contour of a lower portion of the helmet body.

9. The helmet of claim 1, wherein the head fitting system extends downwardly from the shelf.

* * * * *